US012060141B2

(12) United States Patent
Limseth et al.

(10) Patent No.: US 12,060,141 B2
(45) Date of Patent: Aug. 13, 2024

(54) DRIVING DEVICE FOR A VESSEL

(71) Applicant: Seadrive AS, Vear (NO)

(72) Inventors: Finn Limseth, Skallestad (NO); Markus Limseth, Skallestad (NO)

(73) Assignee: Seadrive AS, Vear (NO)

( * ) Notice: Subject to any disclaimer, the term of this patent is extended or adjusted under 35 U.S.C. 154(b) by 279 days.

(21) Appl. No.: 17/440,476

(22) PCT Filed: Mar. 18, 2020

(86) PCT No.: PCT/EP2020/057464
§ 371 (c)(1),
(2) Date: Sep. 17, 2021

(87) PCT Pub. No.: WO2020/187991
PCT Pub. Date: Sep. 24, 2020

(65) Prior Publication Data

US 2022/0177100 A1 Jun. 9, 2022

(30) Foreign Application Priority Data

Mar. 18, 2019 (NO) ..... 20190359

(51) Int. Cl.
*B63H 20/06* (2006.01)
*B63H 1/14* (2006.01)
(Continued)

(52) U.S. Cl.
CPC ..... *B63H 20/06* (2013.01); *B63H 1/14* (2013.01); *B63H 20/10* (2013.01); *B63H 23/34* (2013.01)

(58) Field of Classification Search
CPC ..... B63H 21/00; B63H 21/12; B63H 21/17; B63H 1/00; B63H 1/14; B63H 20/00;
(Continued)

(56) References Cited

U.S. PATENT DOCUMENTS 3,814,961 A 6/1974 Nelson et al.
7,163,426 B2 * 1/2007 Varis ..... B63H 5/125 440/6
(Continued)

FOREIGN PATENT DOCUMENTS

EP 0 590 867 A1 4/1994
EP 2 824 028 A1 1/2015
(Continued)

OTHER PUBLICATIONS

Search Report in counterpart Norwegian U.S. Appl. No. 20/190,359 issued on Apr. 28, 2020 (3 pages).
(Continued)

*Primary Examiner* — Daniel V Venne
(74) *Attorney, Agent, or Firm* — Osha Bergman Watanabe & Burton LLP

(57) ABSTRACT

A drive device for a vessel includes an electric motor, driving a rotatable drive shaft; an elongate drive device housing, encapsulating the electric motor and the drive shaft; and a propeller, detachably mounted to the rotatable drive shaft. The drive device housing has an upper connection device. The upper connection device is symmetrical about a transverse axis, enabling the drive device housing to be mounted to a structure onboard the vessel in either of two longitudinal directions. The drive device and the hull of the vessel are separated from each other by using an isolation plate with a central isolation sleeve. The electric motor drives the drive shaft via an interconnected gear device encapsulated in the drive device housing or integrated as a part of the drive device housing and are arranged pivotably with respect to the tilt device housing.

9 Claims, 17 Drawing Sheets

(51) Int. Cl.
*B63H 20/10* (2006.01)
*B63H 23/34* (2006.01)

(58) Field of Classification Search
CPC ..... B63H 20/007; B63H 20/06; B63H 20/10; B63H 2020/005; B63H 20/34; B63H 23/34; B63H 2005/075; B63H 2005/1258; B63H 5/125; B63H 2025/425; Y02T 70/50
USPC ..... 440/6
See application file for complete search history.

(56) References Cited

U.S. PATENT DOCUMENTS

| | | | | |
|---|---|---|---|---|
| 10,906,621 | B2 * | 2/2021 | Gebhart ..... | B63H 20/007 |
| 2010/0248562 | A1 | 9/2010 | Daikoku | |
| 2011/0318978 | A1 | 12/2011 | Krackhardt et al. | |
| 2017/0327195 | A1 | 11/2017 | Bergmann et al. | |

FOREIGN PATENT DOCUMENTS

| | | | |
|---|---|---|---|
| EP | 3 241 737 | A1 | 11/2017 |
| JP | 2004-090841 | A | 3/2004 |
| WO | 2017/198892 | A1 | 11/2017 |

OTHER PUBLICATIONS

International Preliminary Report on Patentability for corresponding International Application No. PCT/EP2020/057464, mailed May 17, 2021 (12 pages).
International Search Report for corresponding International Application No. PCT/EP2020/057464, mailed Jul. 27, 2020 (7 pages).
Written Opinion for corresponding International Application No. PCT/EP2020/057464, mailed Jul. 27, 2020 (11 pages).

* cited by examiner

DRIVING DEVICE FOR A VESSEL

TECHNICAL FIELD

The present invention relates to a drive device for a vessel.

BACKGROUND

Electrical drive devices for propulsion and maneuvering of vessels are known in the art. There is a need for an improved drive device for a vessel, in particular for a boat which has a non-electrical primary propulsion, such as a sailboat, a houseboat, a historical vessel, or a replica of a historical vessel, and which overcomes various disadvantages of the related art. Examples of related prior art are US

SUMMARY

The present invention has been defined in the accompanying claims.

BRIEF DESCRIPTION OF THE DRAWINGS

Possible features and advantages of the invention will be explained in closer detail in the detailed description below, with reference to the non-limiting examples illustrated in the figures.

DETAILED DESCRIPTION

Figure 1:
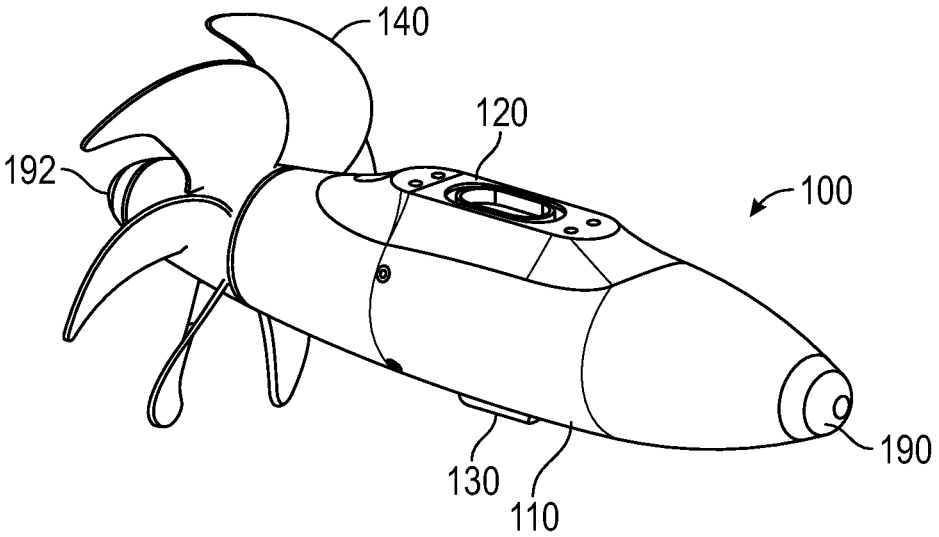
FIG. 1 is a schematic perspective view illustrating a drive device.

The invention will be described in the following as non-limiting examples, which illustrate principles of the invention as claimed. Identical reference numerals refer to identical or similar elements throughout the figures.

FIG. 1 is a schematic perspective view illustrating a drive device.

The drive device is a drive device 100 for a vessel. The drive device 100 is particularly suitable for a vessel in the form of a boat which has a non-electrical primary propulsion, such as a sailboat, a houseboat, a historical vessel, or a replica of a historical vessel. An example of a replica of a historical vessel may be a replica of an ancient wooden boat, for instance a Viking ship.

The drive device 100 may also be designed as a retrofittable drive device.

The drive device 100 includes at least two connectable parts that may be divided vertically in the transverse (as illustrated) or longitudinal direction.

The drive device 100 comprises an electric motor, driving a rotatable drive shaft.

The drive device 100 further comprises an elongate drive device housing 110 which encapsulates the electric motor and the drive shaft.

The drive device 100 further comprises a propeller 140, which is detachably mounted to the rotatable drive shaft.

The drive device housing 110 has an upper connection device 120. The upper connection device is symmetrical about a transverse axis, enabling the drive device housing 110 to be mounted to a structure onboard the vessel in either of two longitudinal directions.

For instance, the drive device housing 110 may be mounted to the structure onboard the vessel via a top mast device connected to the upper connection device. In this case, the upper connection device constitutes a symmetric mast interface of the drive device housing 110.

The drive device housing 110 may also include a lower connection device, illustrated at 130. The lower connection device 130 is symmetrical about a transverse axis 131, enabling the drive device housing to be mounted to a bottom mast or a keel in either of two longitudinal directions.

Figure 2:
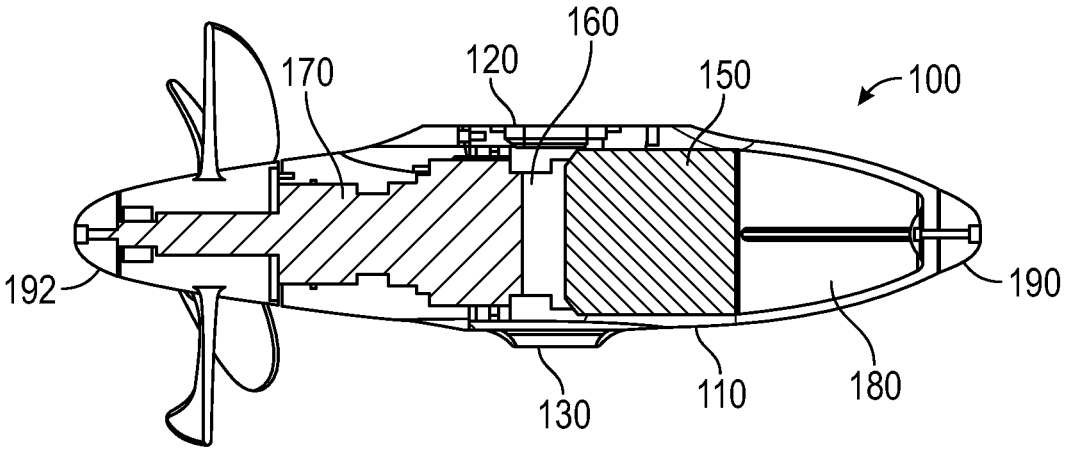
FIG. 2 is a schematic side sectional view illustrating a drive device.

FIG. 2 is a schematic side sectional view illustrating a drive device. The electric motor 150 is connected to a gear device 170 via a motor-gear adapter 160. Electrical power supply to the motor 150 is provided by at least an electric cable guided through a central opening in the upper connection device 120. The electric cable may be further provided through a mast device connected to the upper connection device and further to a power supply unit included in the structure onboard the vessel. The drive device housing 110 may include a space or cavity 180 which may accommodate an electronics device and/or a cooling arrangement. The drive device housing 110 may include distal end portions 190, 192 that may include a sacrificing anode material such as zinc, aluminum or magnesium alloys, for protecting other metal elements from galvanic corrosion in seawater. The distal end portions 190 and 192 may be identical.

Figure 3:
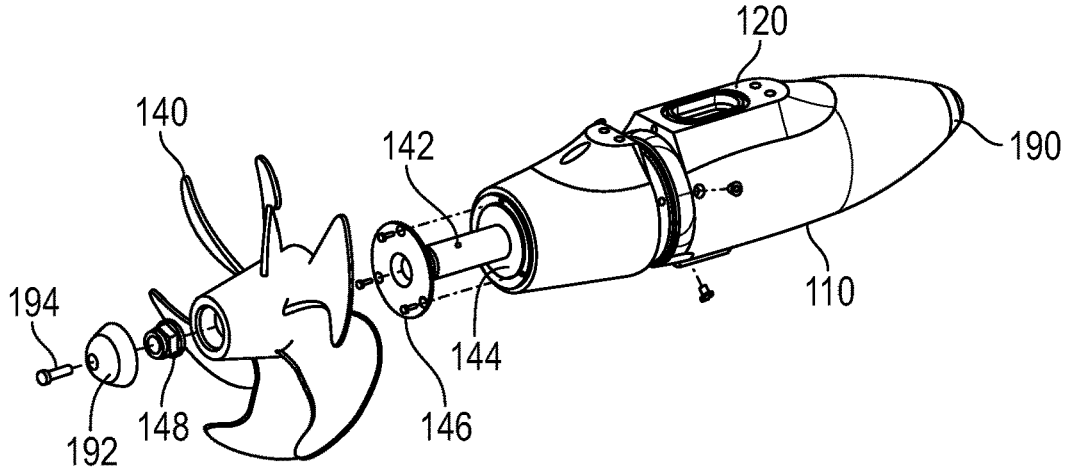
FIG. 3 is a schematic, exploded perspective view illustrating further aspects of a drive device.

FIG. 3 is a schematic, exploded perspective view illustrating further aspects of a drive device.

As shown, the propeller 140 is detachably mounted to the drive shaft 142 with a conical standard shape or splines. A seal 144, such as a double lip seal, is arranged at an end portion of the drive device housing 110 which accommodates the gear device 170. A disc 146 is mounted to the end portion of the drive device housing 110, for instance by means of a plurality of bolts (three illustrated). The propeller 140 is detachably mounted to the drive shaft 142 by means of a lock nut 148 that engages with threads on the drive shaft 142. End portion 192 may be formed as a cap which is secured to the drive shaft by means of a central, axial bolt 194.

Figure 4:
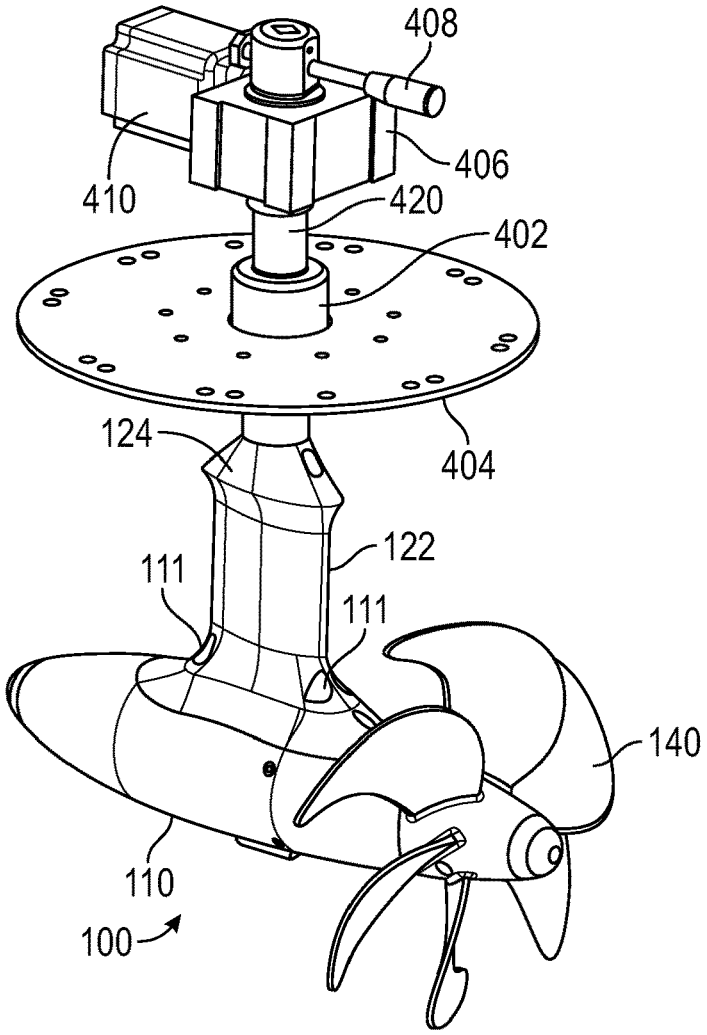
FIG. 4 is a schematic perspective view illustrating a drive device with azimuth operation.

FIG. 4 is a schematic perspective view illustrating a drive device with azimuth operation. The upper connecting device 120 of the drive device 100 is connected to an upper mast device 122 and further to a galvanic isolation separator 124, and further to a vertical shaft 420 which is rotatable with respect to the vessel's hull. A sealing device 402 is attached to the hull, and further locked in place by an adapter plate 404. The lower section of the sealing device 402 may be surrounded by a hydro flow cap. The adapter plate 404 may include holes configured to match bolt patterns for different manufacturers. An electric azimuth motor 410 may rotatably drive an azimuth gear device 406, for instance a worm gear device, which further drives the vertical shaft 420. The azimuth arrangement may further include a direction tiller 408.

The upper mast device 122 may be attached to the drive device 100 at the upper connecting device 120 by means of bolts. These and any other bolts that might otherwise be exposed to water, in particular seawater, may advantageously be covered by bolt covers 111, which may be made by, e.g. an elastomer material and designed to maximize the overall streamlined design while protecting the bolt heads against corrosion.

In an alternative arrangement, the vertical shaft 420 may be manually operable.

Figure 5:
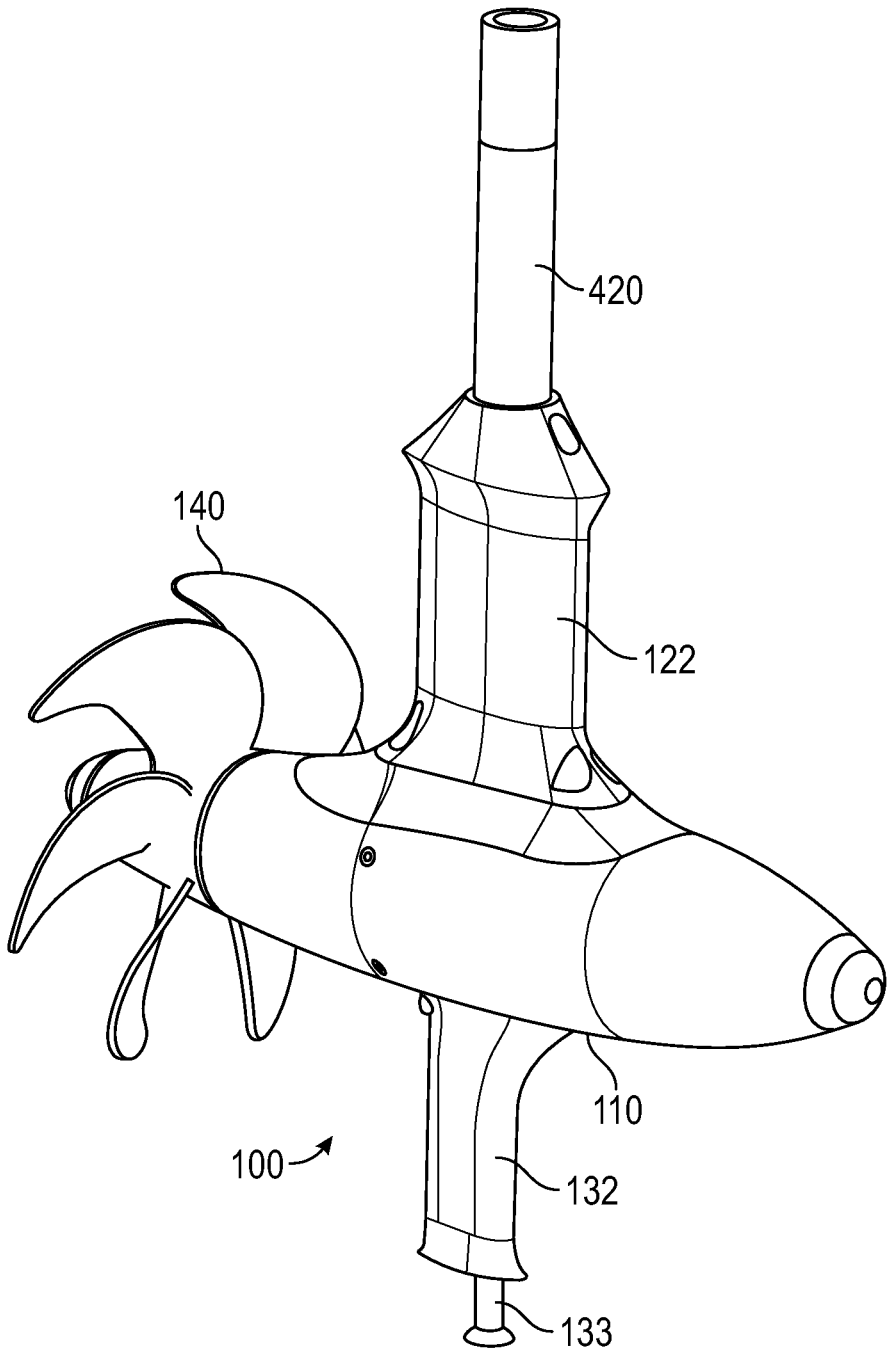
FIG. 5 is a schematic perspective view illustrating further aspects of a drive device with azimuth operation.

FIG. 5 is a schematic perspective view illustrating further aspects of a drive device with azimuth operation. Most of the elements shown on FIG. 5 have already been illustrated in FIG. 4 and described above with reference to FIG. 4. FIG. 5 also shows a bottom mast 132 attached to a lower connection device 130 of the drive device housing 110, arranged at the bottom portion of the drive device housing 110. At the lower end of the bottom mast there is a lower rotatable and fixing point 133 to lower attachments.

Figure 6:
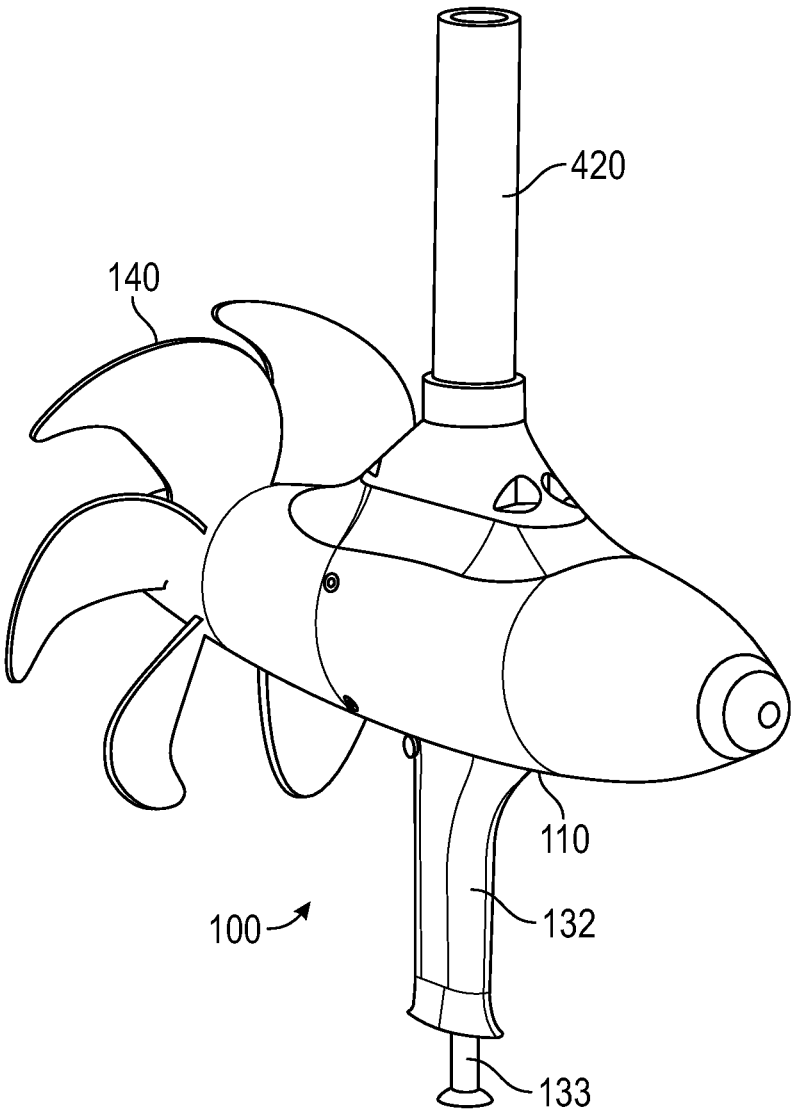
FIG. 6 is a schematic perspective view illustrating yet further aspects of a drive device with azimuth operation.

FIG. 6 is a schematic perspective view illustrating yet further aspects of a drive device with azimuth operation.

In the embodiment of FIG. 6, the upper mast device 122 is omitted and the upper connecting device 120 of the drive device 100 is connected directly to the vertical shaft 420. Otherwise the embodiment of FIG. 6 corresponds to what has been described with reference to the above disclosure, including what has been described with reference to FIGS. 4 and 5.

Figure 7:
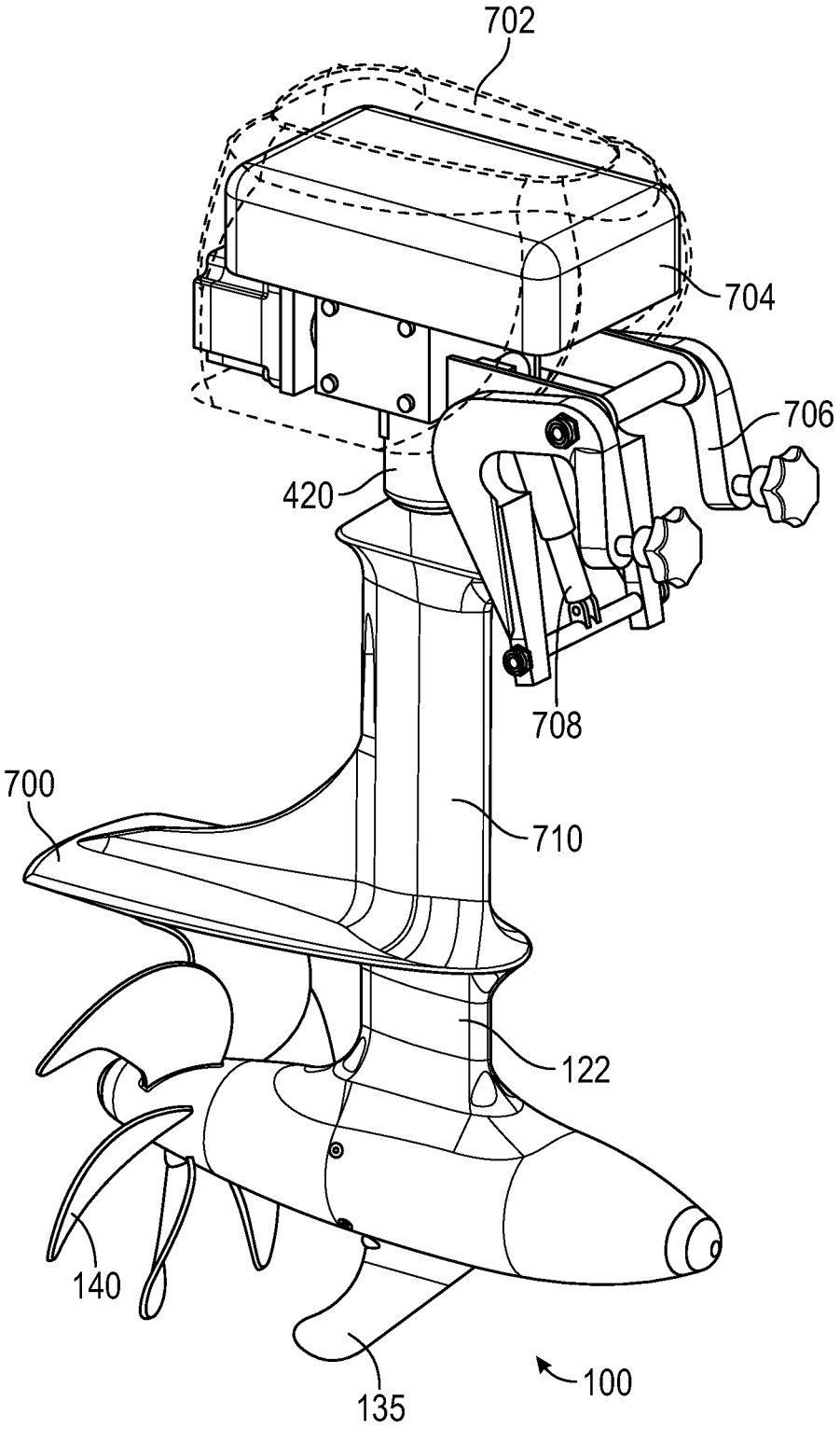
FIG. 7 is a schematic perspective view illustrating an outboard embodiment of a drive device.

FIG. 7 is a schematic perspective view illustrating an outboard embodiment of a drive device.

In this embodiment the upper connecting device 120 of the drive device 100 is connected to an upper mast device 122 which includes a horizontal cavitation plate 700 at its upper end. The horizontal cavitation plate 700 is further connected to another mast device 710 which extends up to a tilt device housing 704 which may include an azimuth motor and gear device that is enabled to rotate the azimuth rotatable shaft 420. A set of two hull fixture clamps 706 are arranged to clamp the tilt device housing 704 to a hull of the boat. An actuator 708 may be arranged to provide a tilt function. A keel 135 is provided at the lower portion of the drive device 100. The keel is attached to the lower connection device 130.

Figure 8:
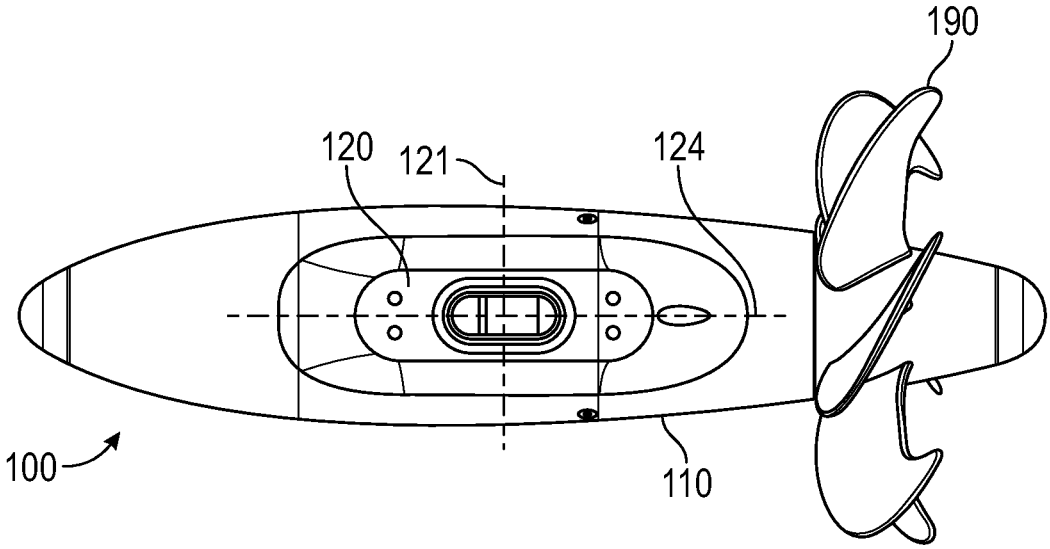
FIG. 8 is a schematic top view illustrating interface aspects of a drive device.

FIG. 8 is a schematic top view illustrating interface aspects of a drive device 100. As shown, the drive device housing has an upper connection device 120, the upper connection device being symmetrical about the transverse axis 121. This enables the drive device housing 110 to be mounted to a structure onboard the vessel, for instance the mast 122 to be attached above the drive device 100, in either of two longitudinal directions. In this case, "longitudinal" corresponds to the direction of the axis 124.

Figure 9:
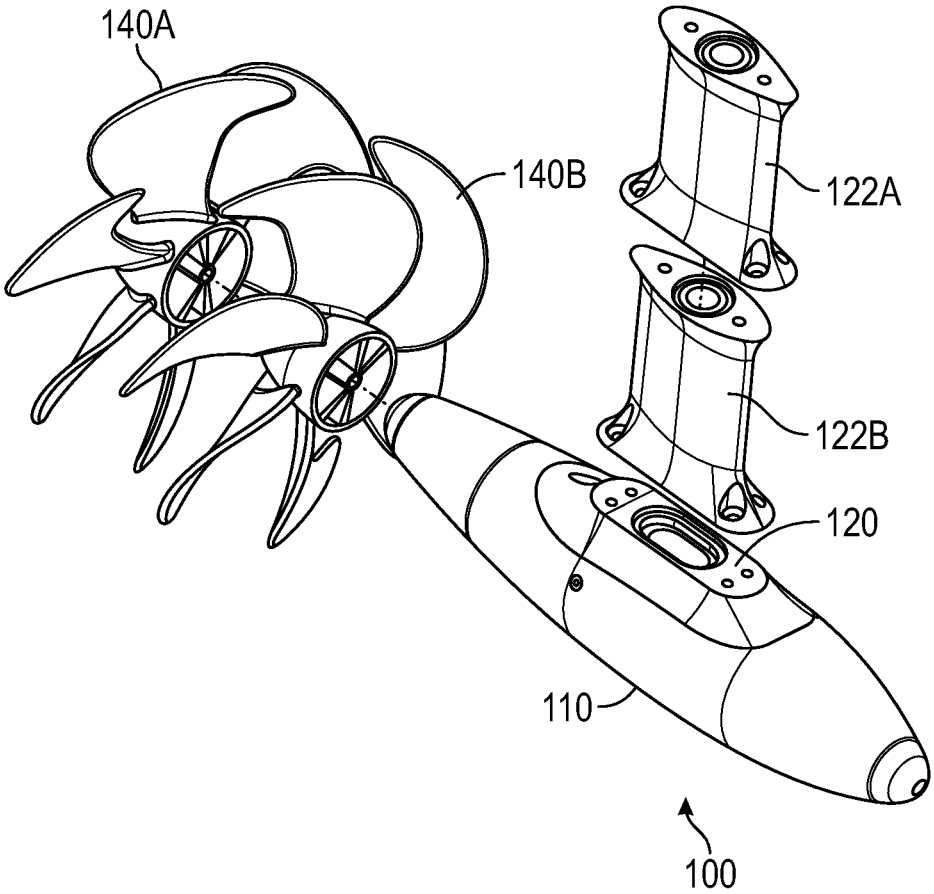
FIG. 9 is a schematic perspective view illustrating interchangeable elements of a drive device.

FIG. 9 is a schematic perspective view illustrating interchangeable elements of a drive device.

The propeller 140 may be interchangeable. In a first configuration, the detachably mounted propeller 140 is a puller propeller, illustrated as 140A, and the drive device housing 110 is mounted to the structure onboard the vessel in such a direction that the puller propeller 140A appears in a forward direction of the vessel.

In this first configuration, if a mast device 122 is interconnected between the structure onboard the vessel, the mast device is arranged as a puller mast device 122A.

In a second configuration, the the detachably mounted propeller 140 is a pusher propeller, illustrated as 140B, and the drive device housing 110 is mounted to the structure onboard the vessel in such a direction that the pusher propeller 140B appears in an astern direction of the vessel.

In this second configuration, if a mast device 122 is interconnected between the structure onboard the vessel, the mast device 122 is arranged as a puller mast device 122B.

The configuration of the mast device 122 as a puller mast device 122A or as a pusher mast device 122B may be achieved by one and the same physical mast device 122, by mounting the mast device in the desired direction, allowed by the upper connection device's symmetrical design about the transverse axis 122.

Figure 10:
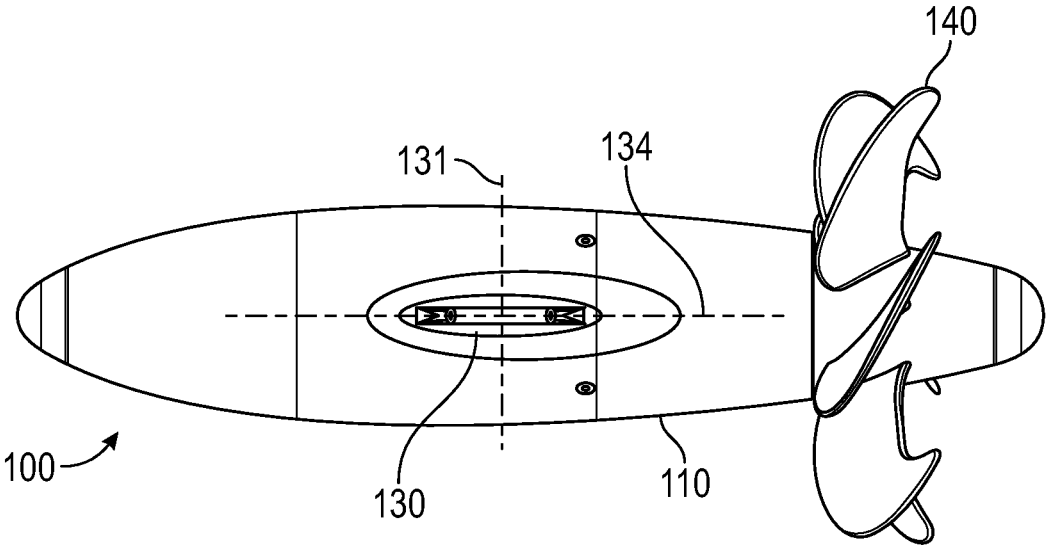
FIG. 10 is a schematic bottom view illustrating interface aspects of a drive device.

FIG. 10 is a schematic bottom view illustrating interface aspects of a drive device 100.

In this aspect, the drive device housing 110 includes a lower connection device 130. The lower connection device 130 is symmetrical about a transverse axis 131, enabling the drive device housing to be mounted to a keel in either of two longitudinal directions. In this case, "longitudinal" corresponds to the direction of the axis 134.

Figure 11:
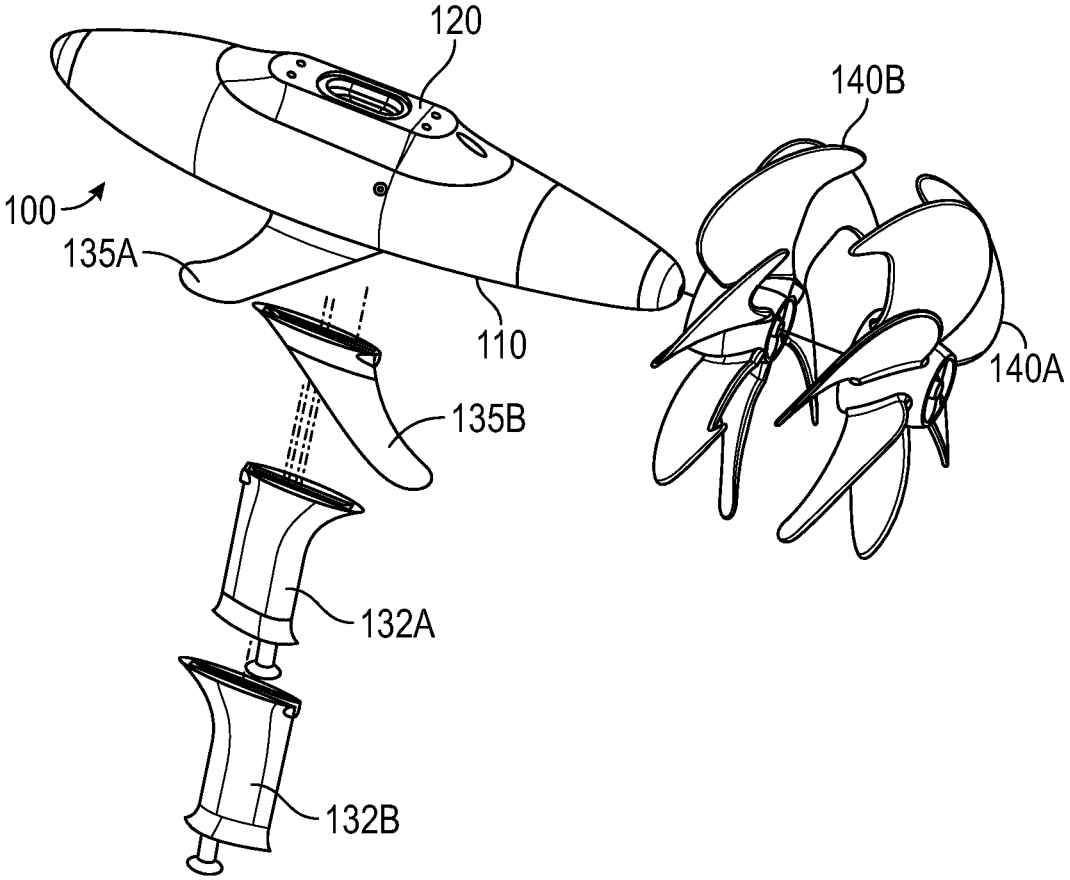
FIG. 11 is a schematic perspective view illustrating further interchangeable elements of a drive device.

FIG. 11 is a schematic perspective view illustrating further interchangeable elements of a drive device.

As will be understood from FIG. 11, keels with various shapes may be attached to the lower connection device 130. Also, due to the symmetrical properties of the lower connection device 130, a keel may be mounted in one of two directions on the lower connection device 130. For instance, a puller keel 135A may be arranged in the case of a puller propeller 140A, and a pusher keel 135B may be arranged in the case of a pusher propeller 140B. The configuration of the keel 135 as a puller keel 135A or as a pusher keel 135B may be achieved by one and the same physical keel 135, by mounting the keel in the desired direction, which is allowed by the lower connection device's 130 symmetrical design about the transverse axis 131.

Figure 12:
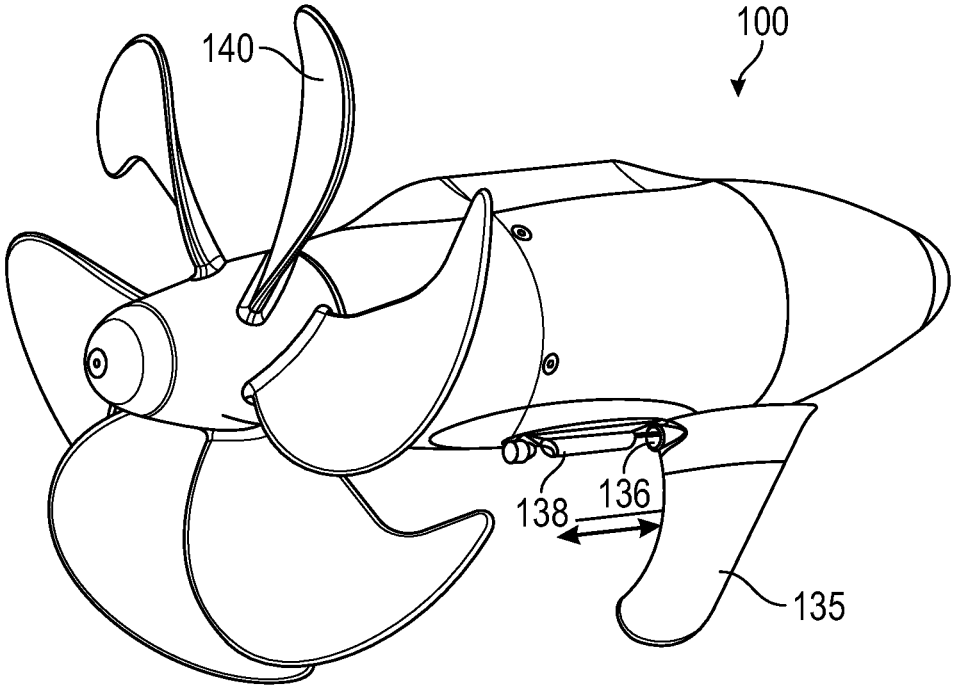
FIG. 12 is a schematic perspective view illustrating aspects of a keel.

FIG. 12 is a schematic perspective view illustrating aspects of a keel 135.

The keel 135 may be provided with a longitudinal, straight groove 136 along its upper portion, which is adapted to fit tightly in a corresponding longitudinal tongue 138 protruding down at the lower connection device 130. The keel may thus be slid on the tongue and secured with a set screw. The symmetrical design about the transverse axis 131 enables the keel to be mounted in either of two longitudinal directions.

Figure 13:
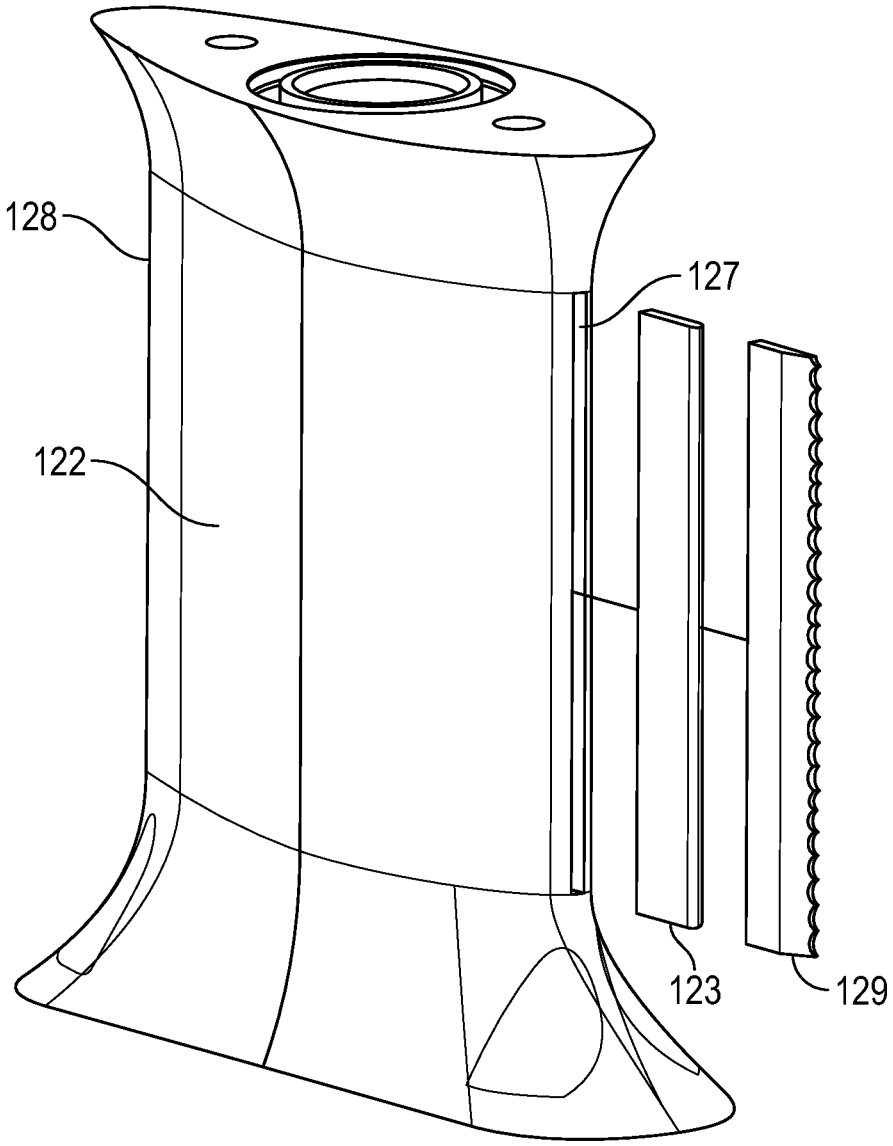
FIG. 13 is a schematic perspective view illustrating aspects of a mast.

FIG. 13 is a schematic perspective view illustrating aspects of a mast. The mast 122 has a hydrodynamic shape with a cross-section that includes a parabolic bow portion 127 and an elliptical stern portion 128. The bow portion 127 may additionally be equipped with a vertical knife element 129 along its front edge, arranged for cutting ropes, lines plastic bags, etc. that may otherwise accumulate around the mast. Alternatively, when a sharp edge is not desired or necessary, a soft front 123, for instance made of rubber material, may be arranged instead or additionally.

Figure 14:
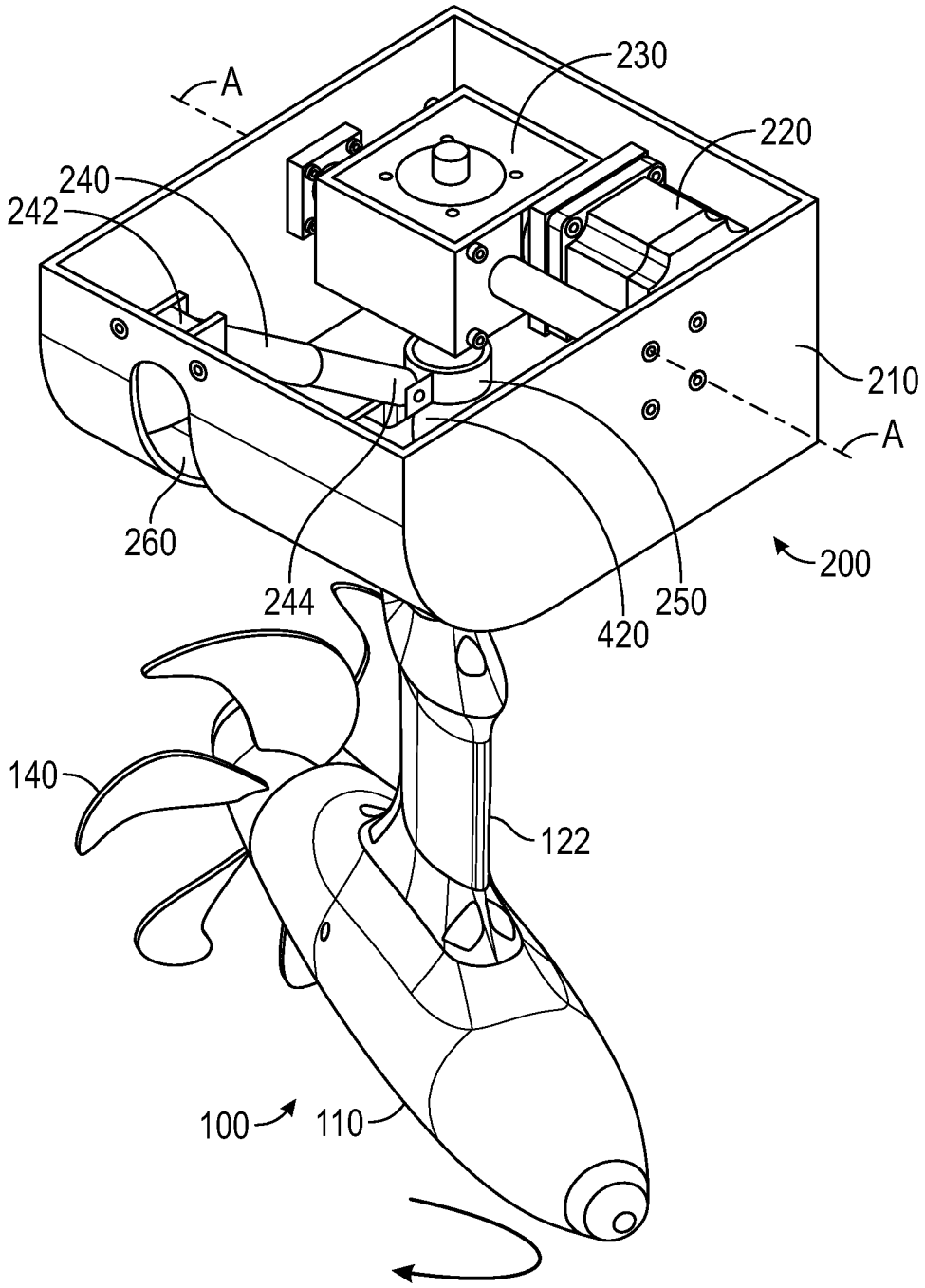
FIG. 14 is a schematic perspective view illustrating aspects of a drive device with azimuth operation and a tilt device, arranged in a vertical, lowered position.

FIG. 14 is a schematic perspective view illustrating aspects of a drive device with azimuth operation and a tilt device, arranged in a vertical, lowered position.

The drive device 100 illustrated in FIG. 14 includes all the elements shown and described with reference to FIG. 5 above. In addition, the drive device 100 illustrated in FIG. 14 includes a tilt device 200 that is arranged to tilt the drive device 100 between a lowered, operational position and a raised-non-operational position. FIG. 14 shows the drive device in a lowered, operational position.

The tilt device 200 includes a tilt device housing 210 which includes an electric azimuth motor 220 connected to a rotatable shaft 420. Advantageously, the electric azimuth motor has a rotor shaft which is connected to a transmission unit 230. The transmission unit 230 advantageously includes a reduction gear. In this case the motor shaft of the azimuth motor 220 is connected to the rotatable shaft 420 via the transmission unit 230.

The rotatable shaft 420 is connected to the drive device housing 110, advantageously as shown, via the mast device 122, which has previously been described above, i.a. with reference to FIG. 5.

The electric azimuth motor 220 and its interconnected transmission unit 230 are advantageously arranged pivotably with respect to the tilt device housing. The pivotable arrangement provides a rotation of the azimuth motor 220 and the transmission unit 230 about a horizontal axis A.

Advantageously, to enable an effective tilt function, the tilt device 200 further includes a linear actuator 240 with a first end 242 and a second end 244, the first end 242 being pivotably connected to the tilt device housing and the second end being pivotably connected to a rotatable member 250 which is set in a fixed position from transmission unit 230 arranged to lift the rotatable shaft 420.

The tilt device housing 210 has a curved slit 260 on its underside, allowing the rotatable shaft to move along and within the slit during the tilt movement provided by the linear actuator 240. A skirt to prevent water from splashing into tilt device housing 210 may be mounted protruding down from the curved slit 260. Drainage tubes may be mounted in the lower bottom of the tilt device housing 210.

Figure 15:
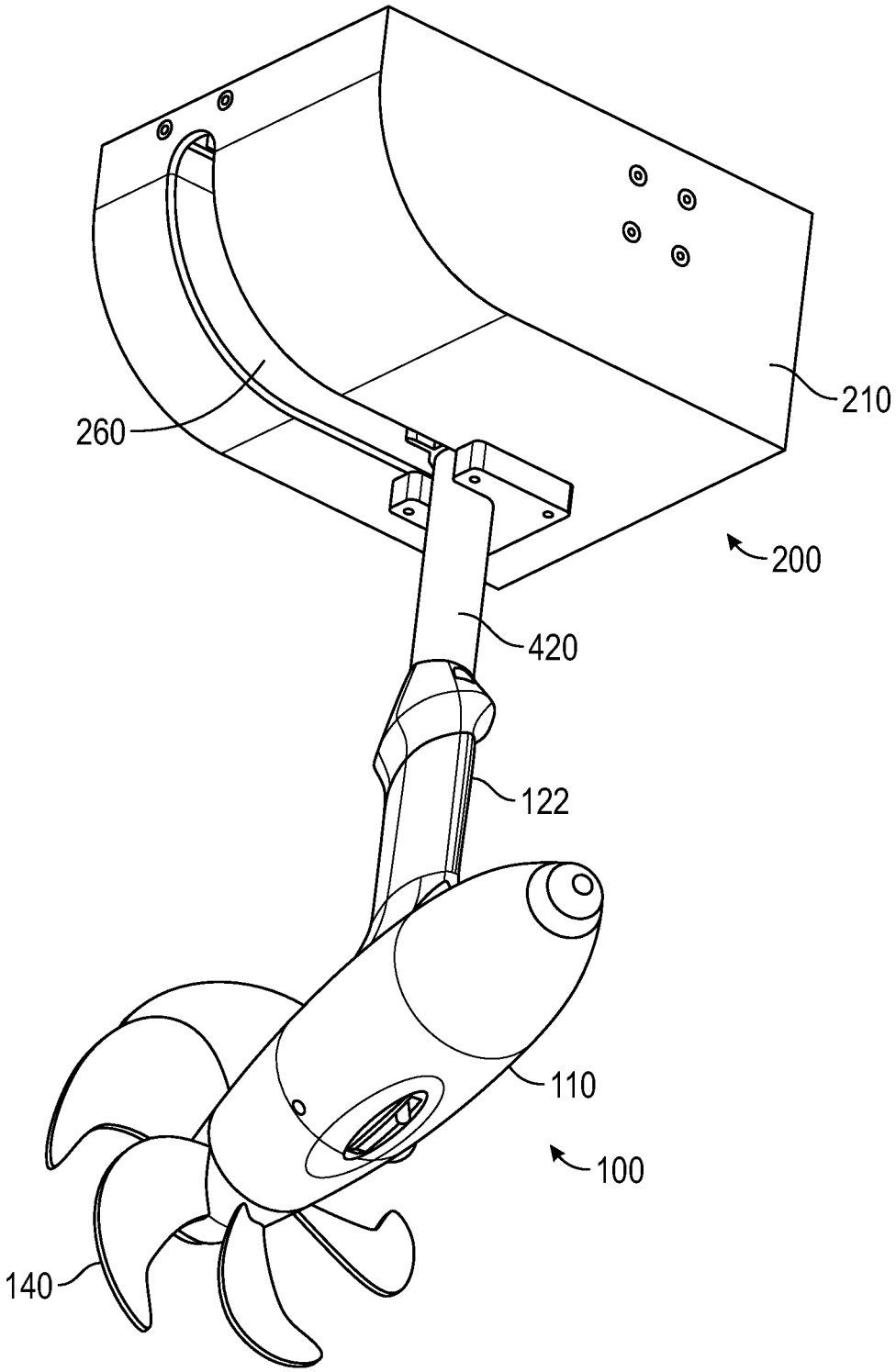
FIG. 15 is a schematic perspective view, from a lower angle, illustrating aspects of a drive device with azimuth operation and a tilt device, arranged in a vertical, lowered position.

FIG. 15 is a schematic perspective view, from a lower angle, illustrating aspects of a drive device with azimuth operation and a tilt device, arranged in a vertical, lowered position.

The elements shown in FIG. 15 corresponds to those shown in FIG. 14.

Figure 16:
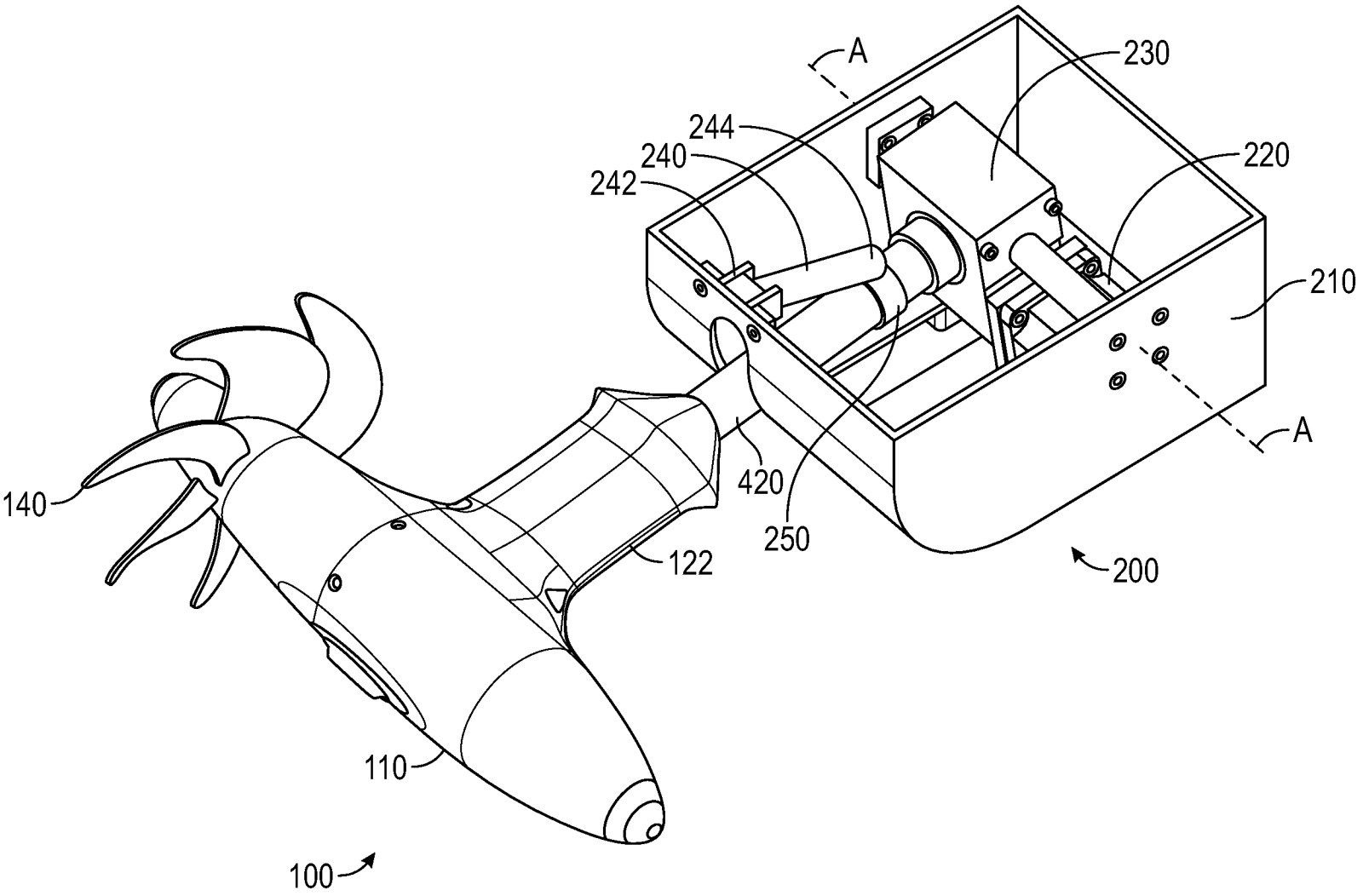
FIG. 16 is a schematic perspective view illustrating aspects of a drive device with azimuth operation and a tilt device, arranged in a raised position.

FIG. 16 is a schematic perspective view illustrating aspects of a drive device with azimuth operation and a tilt device, arranged in a raised position.

The elements shown in FIG. 16 corresponds to those shown in FIGS. 14 and 15.

However, it is noted that the linear actuator 240 has been shown in retracted state in FIG. 16, which has resulted in that the rotatable shaft 420 has been erected to a raised, almost horizontal position.

Figure 17:
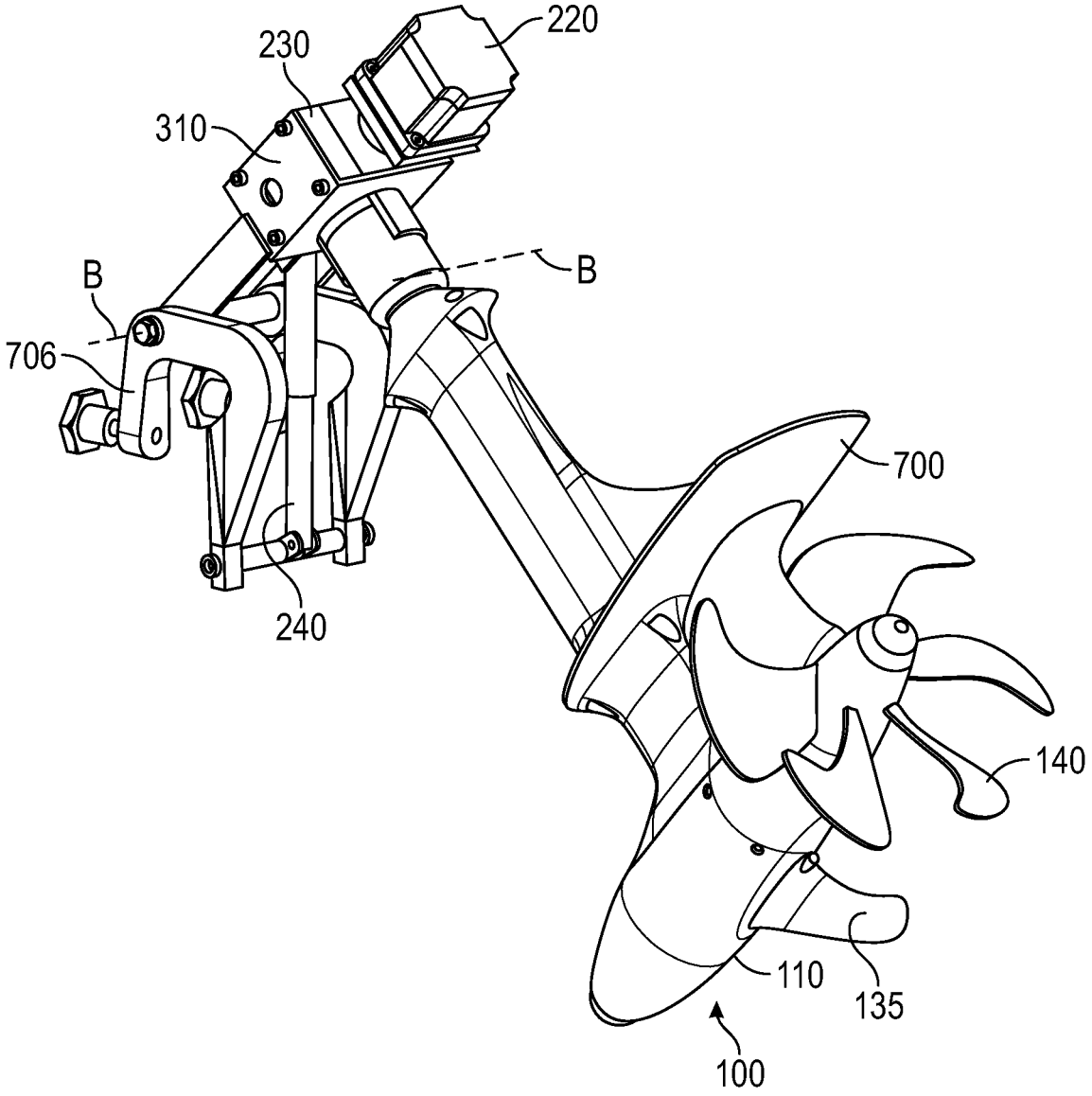
FIG. 17 is a schematic perspective view illustrating aspects of an outboard embodiment of a drive device and a tilt device, arranged in a partly raised position.

FIG. 17 is a schematic perspective view illustrating aspects of an outboard embodiment of a drive device and a tilt device, arranged in a partly raised position.

Figure 18:
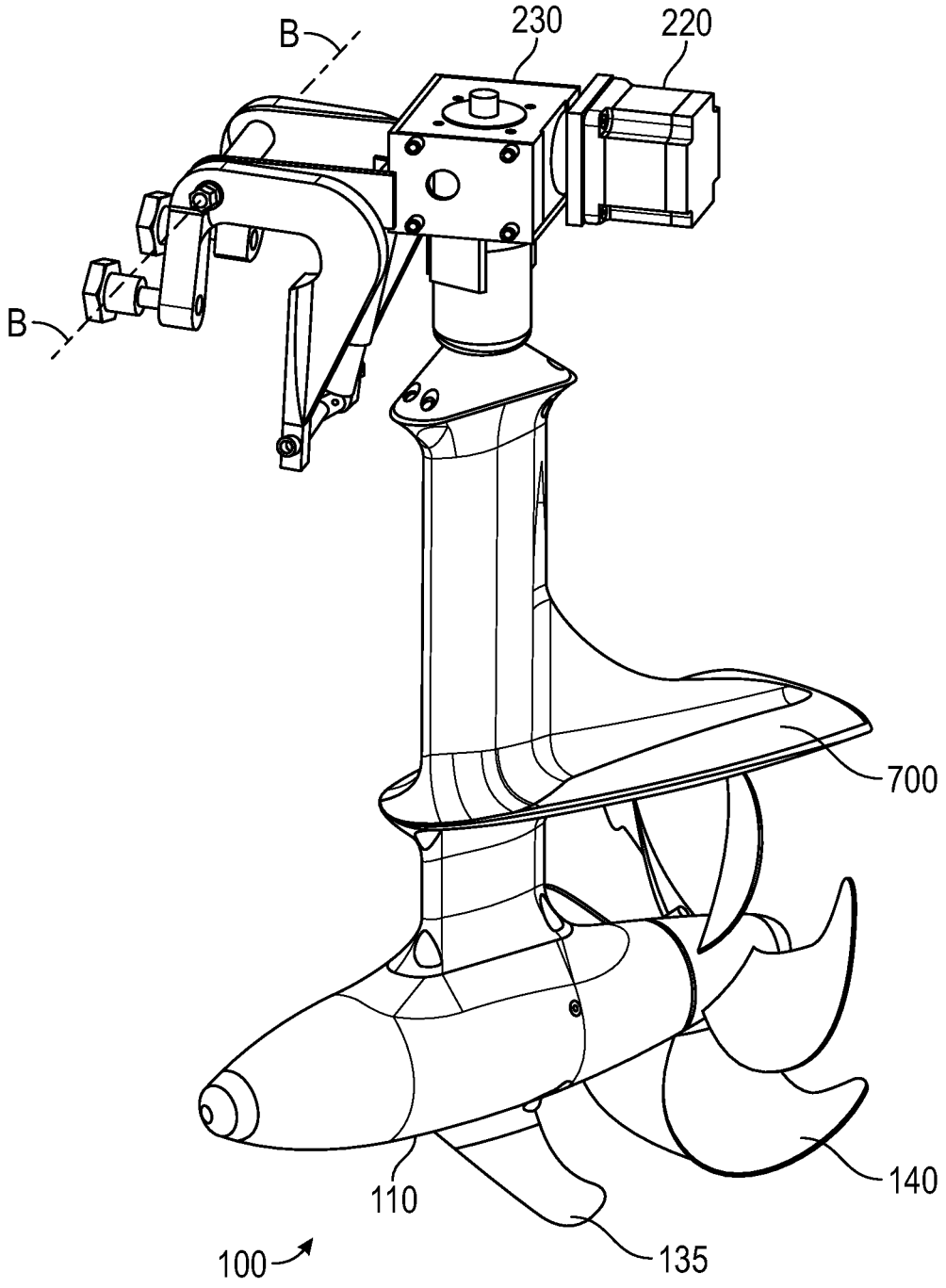
FIG. 18 is a schematic perspective view illustrating aspects of an outboard embodiment of a drive device and a tilt device, arranged in a vertical, lowered position.

The drive device illustrated in FIG. 17 includes a tilt device 300 that is arranged to tilt the drive device 100 between a lowered, operational position and a raised-non-operational position. FIG. 18 shows the drive device in a lowered, operational position.

The tilt device 300 includes a hull fixture clamp device 706, which rotates around horizontal axis B. A tilt device housing 310 which includes an electric azimuth motor 220 connected to a rotatable shaft 420. Advantageously, the electric azimuth motor has a rotor shaft which is connected to a transmission unit 230. The transmission unit 230 advantageously includes a reduction gear. In this case the motor shaft of the azimuth motor 220 is connected to the rotatable shaft 420 via the transmission unit 230.

The rotatable shaft 420 is connected to the drive device housing 110, advantageously as shown, via the mast device 122 with a horizontal cavitation plate 700, which has previously been described above, i.a. with reference to FIG. 5.

The tilt device housing with electric azimuth motor 220 and its interconnected transmission unit 230 are advantageously arranged pivotably with respect to the hull fixture clamp device about a horizontal axis B.

Advantageously, to enable an effective tilt function, the tilt device 300 further includes a linear actuator 240 with a first end 242 and a second end 244, the first end 242 being pivotably connected to the hull fixture clamp device XXX and the second end being pivotably connected to the tilt device housing 310, arranged to lift the rotatable shaft 420.

FIG. 18 is a schematic perspective view illustrating aspects of an outboard embodiment of a drive device and a tilt device, arranged in a vertical, lowered position.

Figure 19:
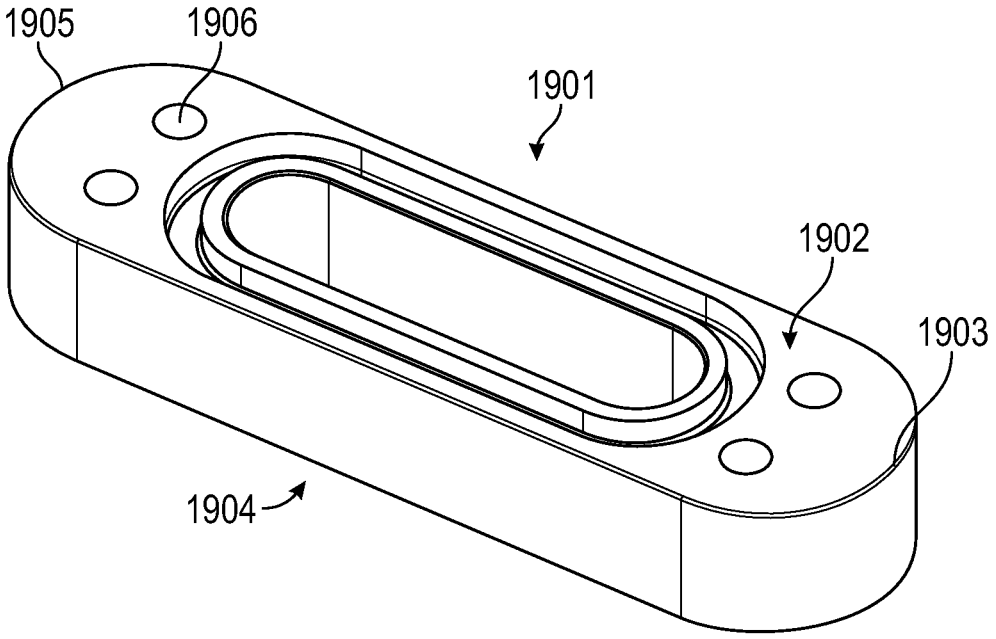
FIG. 19 is a perspective view illustrating a prolonger spacer.

FIG. 19 is a perspective view illustrating a prolonger spacer 1901. The prolonger spacer 1901 extends the space between the hull of the vessel and the pod. The prolonger spacer 1901 is placed between the pod and the mast. The prolonger spacer has a top 1902 and a bottom 1904 surface and a first 1903 and a second 1905 end that is rounded. At either end 1903, 1905 of the prolonger spacer 1901 there is two vertical holes 1906 for attaching the pod to the mast.

The prolonger spacer 1901 allows e.g. for fitting a larger propeller. A typical extension would be between 2.5-7.6 cm. However, the extension is not limited to this interval and can be both larger and smaller than this.

Further the prolonger spacer 1901 has the same interface between the pod and the mast as the upper connection device 120. This ensures that it is compatible with all pods and masts. It also has the same O-ring sealing as the upper connection device 120.

Figure 20:
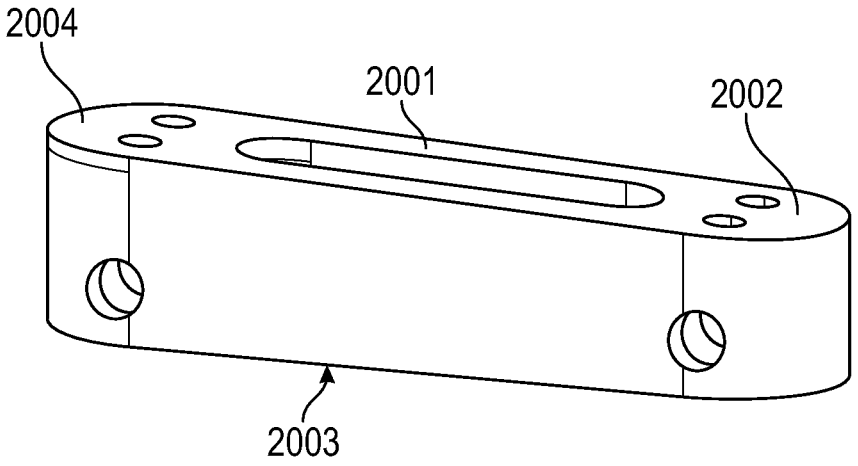
FIG. 20 is a perspective view illustrating of a prolonger spacer with a tilt.

FIG. 20 is a perspective view illustrating a prolonger spacer with a tilt 2001. This allows for adjusting the tilt of the pod in relation to the mast. In this solution the spacer 2001 has a bottom surface 2003 that is connected to the pod that is level. In this solution the upper surface that connects to the mast is tilted. This results in a first end 2004 of the prolonger spacer 1901 has a greater distance between the top and the bottom surface than the second end 2002. In the illustration the angle of the tilt is 3°, however the angle of the tilt can be both bigger and smaller than this. Typically, the angle would be between 1° and 10° to the bottom surface.

Figure 21:
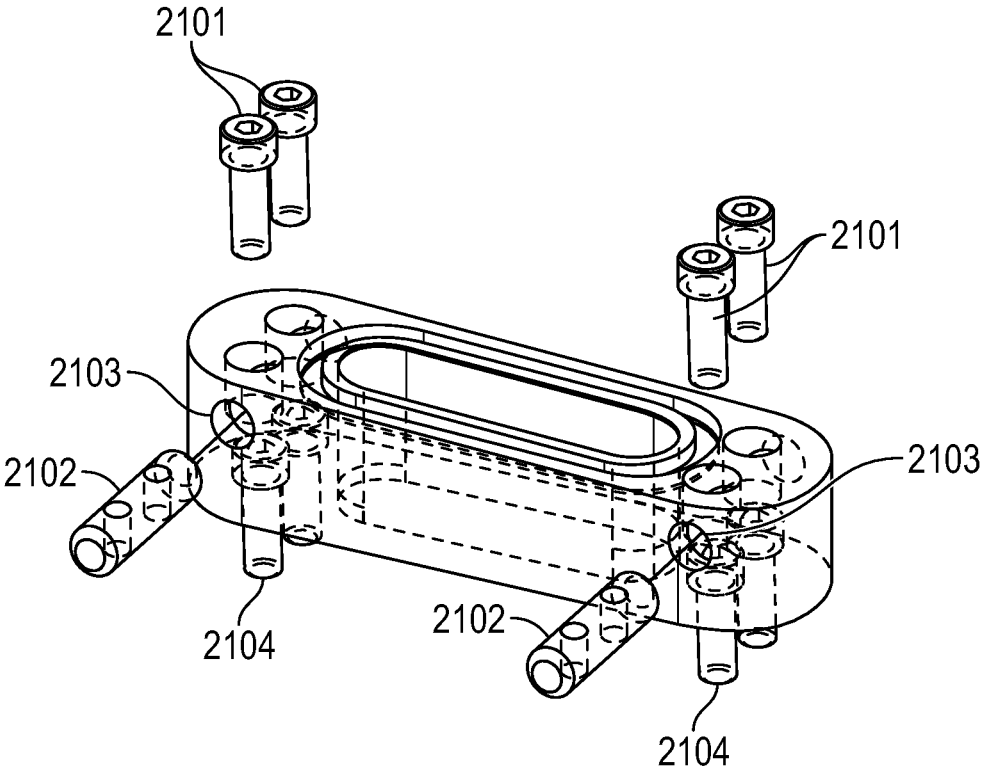
FIG. 21 is a perspective view of the fastening solution of the prolonger spacer.

FIG. 21 is a perspective view of the fastening solution of the prolonger spacer with a tilted upper surface 2001. The prolonger spacer 2001 has a top and a bottom surface and a first and a second end that is rounded. At either end of the prolonger spacer 2001 there is two vertical holes 2103 for attaching the pod to mast. In either hole 2103 there is a bottom 2104 and an upper 2101 bolt. The bottom bolt 2104 secures the prolonger spacer 2001 to the pod. The bottom 2104 bolt is screwed into the pod. The upper bolt 2101 secures the mast to the prolonger 2001. The upper bolts 2101 are screwed into a horizontal rod 2102 at either end of the prolonger spacer 2001. The horizontal rod 2102 is placed in a horizontal hole 2103 that goes through both of the vertical holes at either end of the prolonger spacer. The horizontal bolts 2102 have two threaded holes going through them that is equally spaced apart as the two vertical holes at either end of the prolonger spacer 2001. The two upper bolts 2101 at either end of the prolonger spacer is screwed into the threaded holes of their respective horizontal bolt 2102. This secures the pod to the mast when using a prolonger 2001.

Further since the horizontal bolts 2102 can be twisted around in the horizontal holes 2103 the horizontal bolts 2103 can be aligned to fit any tilt of the prolonger spacer 2001.

Since the O-rings are the same as in the upper connection device 120 this ensures the water seal between the pod and the mast and it fits all pods and masts.

Figure 22:
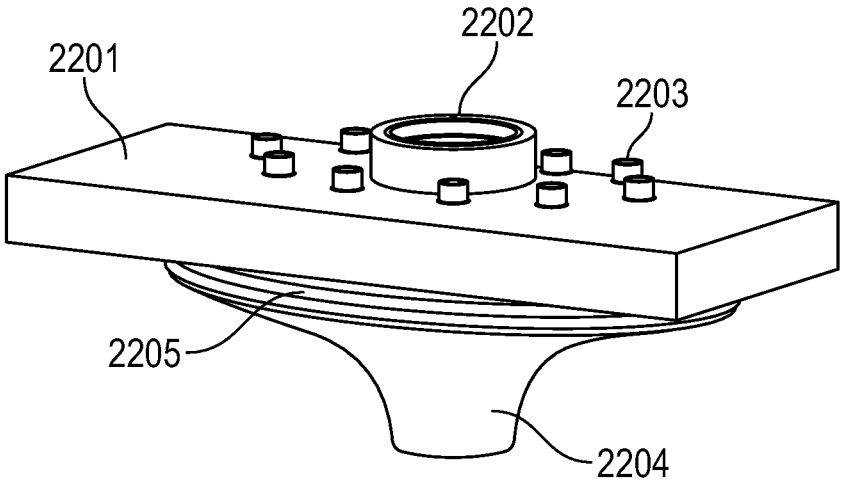
FIG. 22 is a perspective view of an isolation plate for fastening bracket towards the hull of a vessel.

FIG. 22 is a perspective view of how an isolation plate 2205 is situated between a fastening bracket 2204 and the hull 2201 of a vessel. When connecting the fastening bracket 2204 to the hull 2201 of a vessel it is important to use an isolation plate 2205 to ensure galvanic isolation between the hull 2201 of the vessel and the pod. The isolation plate 2205 is of a material less noble than the material of the pod. A typical material to use in the isolation plate is zinc.

The isolation plate 2205 is placed between the fastening bracket 2204 of the pod and the hull of the vessel. The isolation plate 2205 ensures that no part of the fastening bracket 2204 and the hull of the vessel touches each other.

Figure 23:
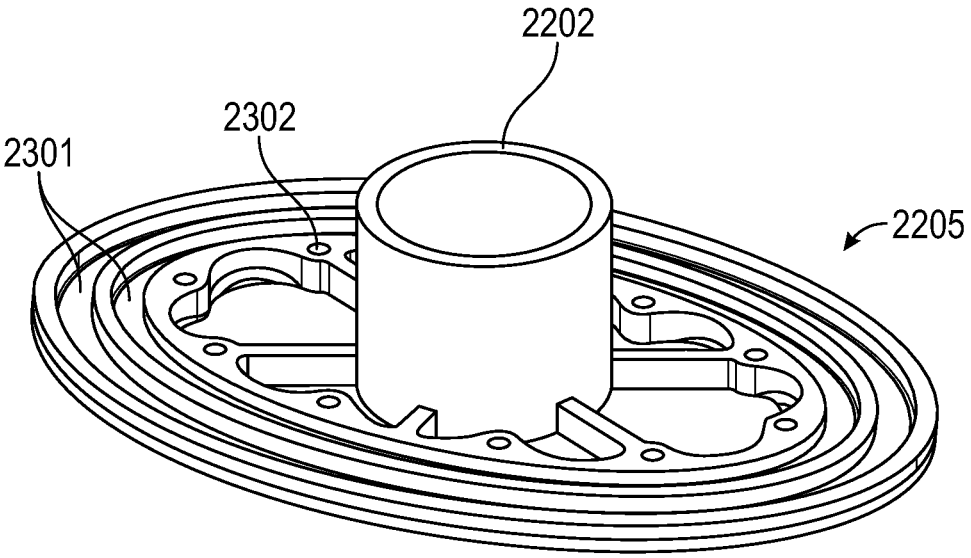
FIG. 23 is a perspective view of the isolation plate from FIG. 22.

FIG. 23 is a perspective view of the isolation plate 2205 with the isolation sleeve 2202 from FIG. 22. The isolation plate 2205 is in the form of a disk with an isolation sleeve 2202 in the middle. In a preferred solution the disk shape has the same shape as the top of the fastening bracket 2204 of the pod. Further, it has at least one groove 2301 for an O-ring ensuring that there is a watertight seal between the hull of the vessel and the isolation plate 2205. Also, the isolation plate 2205 has a set of holes 2302 that allows the bolts attaching the pod to the hull of the boat to go through them. The bolts go through holes in the hull and the holes 2302 in the isolation sleeve 2205 and screws into threaded holes in the fastening bracket 2204 of the pod. The bolts are also isolated from the hull of the vessel by a bolt isolation sleeve 2401. Each bolt has its own bolt isolation sleeve 2401. The bolt isolation sleeve 2401 has an upper flange that ensures that the head of the bolts do not touch the inside of the hull 2201 of the vessel. Further the bolt isolation sleeve 2401 goes through the hole in the hull of the vessel and the bolt goes through the bolt isolation sleeve 2401 ensuring that the bolt do not touch the hull of the vessel.

The isolation plate 2205 further has an isolation sleeve 2202 at the center that allows the vertical shaft that transfers the power from the engine to the propeller to go through it. This isolation sleeve 2202 goes up through the hull 2201 of the vessel and ensures that the vertical shaft do not touch the hull 2201 of the vessel.

Figure 24:
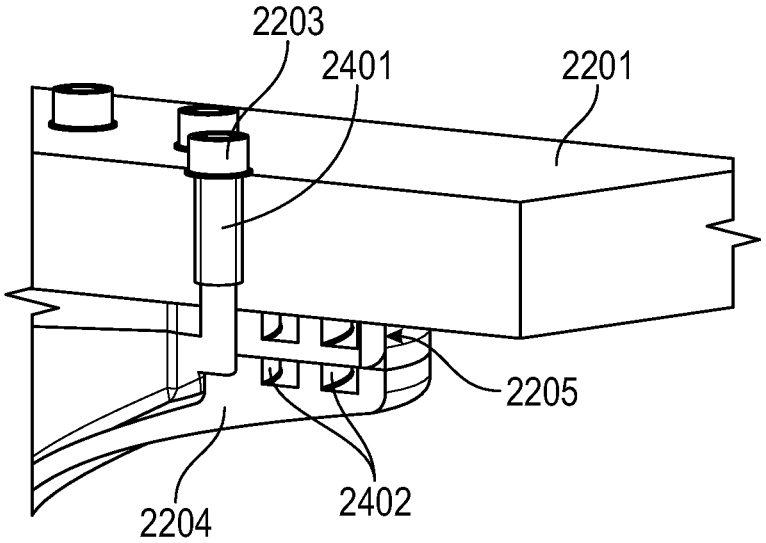
FIG. 24 is a perspective view of how the isolation plate and the isolation sleeve is fastened to the hull of the vessel.

FIG. 24 is a perspective view of a cross section of how the isolation plate 2205 is fastened to the hull of the vessel. The isolation plate 2205 has grooves 2301 for the O-rings on the side that faces the hull 2201 of the ship. On the opposite side it is flush in order to ensure the O-rings placed in the groves 2402 of the fastening bracket gets a water tight seal between the fastening bracket and the isolation plate. The bolt isolation sleeves 2401 is also shown in this illustration.

In any of the above embodiments and aspects, the various parts may be manufactured in materials suitable for underwater use, in particular seawater use. Example materials are aluminum, stainless steel, bronze or various composites.

The drive device and its respective parts may advantageously be equipped with safety break off points, which is an advantage to reduce damage in case of running aground in shallow water.

The modular design facilitates for attachment of various types of propellers and propellers embodiment, including foldable propellers, kort nozzles and propeller guards.

Also, a catch line may be attached between the drive device or its respective parts and the vessel, in order to prevent complete loss of equipment in case of a break-off.

The invention has been described in detail above as non-limiting examples. It should be understood that the invention can be modified to include various alterations and substitutions. Hence, the invention is not limited by the foregoing detailed description, but by the scope of the claims.

The invention claimed is:

1. A drive device for a vessel, comprising:

an electric motor, driving a rotatable drive shaft;

an elongate drive device housing, encapsulating the electric motor and the rotatable drive shaft;

a propeller, detachably mounted to the rotatable drive shaft;

wherein the elongate drive device housing has an upper connection device, the upper connection device being symmetrical about a transverse axis, enabling the elongate drive device housing to be mounted to a structure onboard the vessel in either of two longitudinal directions, and the drive device and a hull of the vessel are separated from each other by using an isolation plate with a central isolation sleeve, the electric motor drives the rotatable drive shaft via an interconnected gear device encapsulated in the elongate drive device housing or integrated as a part of the elongate drive device housing and is arranged pivotably with respect to a tilt device housing.

2. The drive device according to claim 1, wherein the vessel is a boat which has a non-electrical primary propulsion and comprises a sailboat, houseboat, a historical vessel, or a replica of the historical vessel.

3. The drive device according to claim 1, wherein the drive device is a retrofittable drive device.

4. The drive device according to claim 1, wherein the elongate drive device housing is mounted to the structure onboard the vessel via a top mast device connected to the upper connection device.

5. The drive device according to claim 1, wherein the drive device and the hull are attached to each other using a plurality of bolts and each bolt has its own bolt isolation sleeve.

6. The drive device according to claim 1, wherein the detachably mounted propeller is a puller propeller and the elongate drive device housing is mounted to the structure onboard the vessel in such a direction that the puller propeller appears in a forward direction of the vessel, or wherein the detachably mounted propeller is a pusher propeller and the elongate drive device housing is mounted to the structure onboard the vessel in such a direction that the puller propeller appears in an astern direction of the vessel.

7. The drive device according to claim 1, wherein the structure onboard the vessel is fixed with respect to the hull of the vessel.

8. The drive device according to claim 1, wherein the structure onboard the vessel includes a vertical shaft which is rotatable with respect to the hull of the vessel.

9. The drive device according to claim 8, wherein the vertical shaft is rotatable by means of an electric azimuth motor.

* * * * *